US011541663B2

(12) United States Patent
Hiramoto

(10) Patent No.: US 11,541,663 B2
(45) Date of Patent: Jan. 3, 2023

(54) LIQUID EJECTION APPARATUS AND LIQUID REFILL CONTAINER

(71) Applicant: CANON KABUSHIKI KAISHA, Tokyo (JP)

(72) Inventor: Atsushi Hiramoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/185,738

(22) Filed: Feb. 25, 2021

(65) Prior Publication Data

US 2021/0268800 A1 Sep. 2, 2021

(30) Foreign Application Priority Data

Feb. 28, 2020 (JP) ..... JP2020-033878

(51) Int. Cl.
*B41J 2/175* (2006.01)

(52) U.S. Cl.
CPC ..... *B41J 2/17509* (2013.01); *B41J 2/1754* (2013.01); *B41J 2/17553* (2013.01)

(58) Field of Classification Search
CPC ... B41J 2/17509; B41J 2/1754; B41J 2/17553
See application file for complete search history.

(56) References Cited

U.S. PATENT DOCUMENTS

2018/0015464 A1 1/2018 Levner et al.
2019/0039381 A1* 2/2019 Ishizawa ..... B41J 2/17506

FOREIGN PATENT DOCUMENTS

| | | | | |
|---|---|---|---|---|
| CN | 100415527 C | * | 9/2008 | ..... B41J 2/1752 |
| CN | 102463745 A | | 5/2012 | |
| CN | 20284718 U | | 4/2013 | |
| CN | 204382809 U | | 6/2015 | |
| CN | 207310859 U | | 5/2018 | |
| CN | 108237780 A | | 7/2018 | |
| CN | 110341315 A | | 10/2019 | |
| JP | 2019-025862 A | | 2/2019 | |
| WO | 2015/111244 A1 | | 7/2015 | |

* cited by examiner

*Primary Examiner* — Justin Seo
(74) *Attorney, Agent, or Firm* — Canon U.S.A., Inc. I.P. Division

(57) ABSTRACT

A liquid ejection apparatus includes: a liquid ejection head configured to eject liquid; a liquid storage container including a storage portion configured to store liquid to be supplied to the liquid ejection head, an opening configured to supply liquid from a liquid refill container to the storage portion, and a cover member configured to be in a first state to cover the opening and a second state to expose the opening; and a regulation unit configured to regulate transition from the first state to the second state of the cover member. Regulating by the regulation unit is released when a first portion, of the liquid refill container, configured to prevent misfilling the storage portion with an incorrect liquid, is fitted into a second portion of the liquid ejection apparatus.

13 Claims, 6 Drawing Sheets

LIQUID EJECTION APPARATUS AND LIQUID REFILL CONTAINER

BACKGROUND

Field of the Disclosure

The present disclosure relates to a liquid ejection apparatus and a liquid refill container.

Description of the Related Art

Some liquid ejection apparatuses that eject liquid from a liquid ejection head allow users to refill with liquid from the outside. Such a liquid ejection apparatus includes a liquid storage container that stores liquid, and a user can refill the liquid storage container with the liquid from a liquid refilling container in the form of, for example, a bottle at any point in time. To prevent the user from accidentally refilling the liquid storage container with a wrong color or type of liquid, Japanese Patent Laid-Open No. 2019-25862 describes a liquid ejection apparatus including a liquid storage container each having one of slot portions that differ in accordance with the type of liquid, and a liquid refill container has a protrusion fittable to the slot portion so as to function as a mis-insertion preventing portion.

SUMMARY

According to an aspect of the present disclosure, there is provided a liquid ejection apparatus including a liquid ejection head configured to eject liquid, a liquid storage container including a storage portion configured to store liquid to be supplied to the liquid ejection head, an opening configured to supply liquid from a liquid refill container to the storage portion, and a cover member configured to be in a first state to cover the opening and a second state to expose the opening, and a regulation unit configured to regulate transition from the first state to the second state of the cover member, wherein regulating by the regulation unit is released when a first portion, of the liquid refill container, configured to prevent from misfilling the storage portion with liquid is fitted into a second portion of the liquid ejection apparatus.

further features of the present disclosure will become apparent from the following description of exemplary embodiments with reference to the attached drawings.

Figure 1:
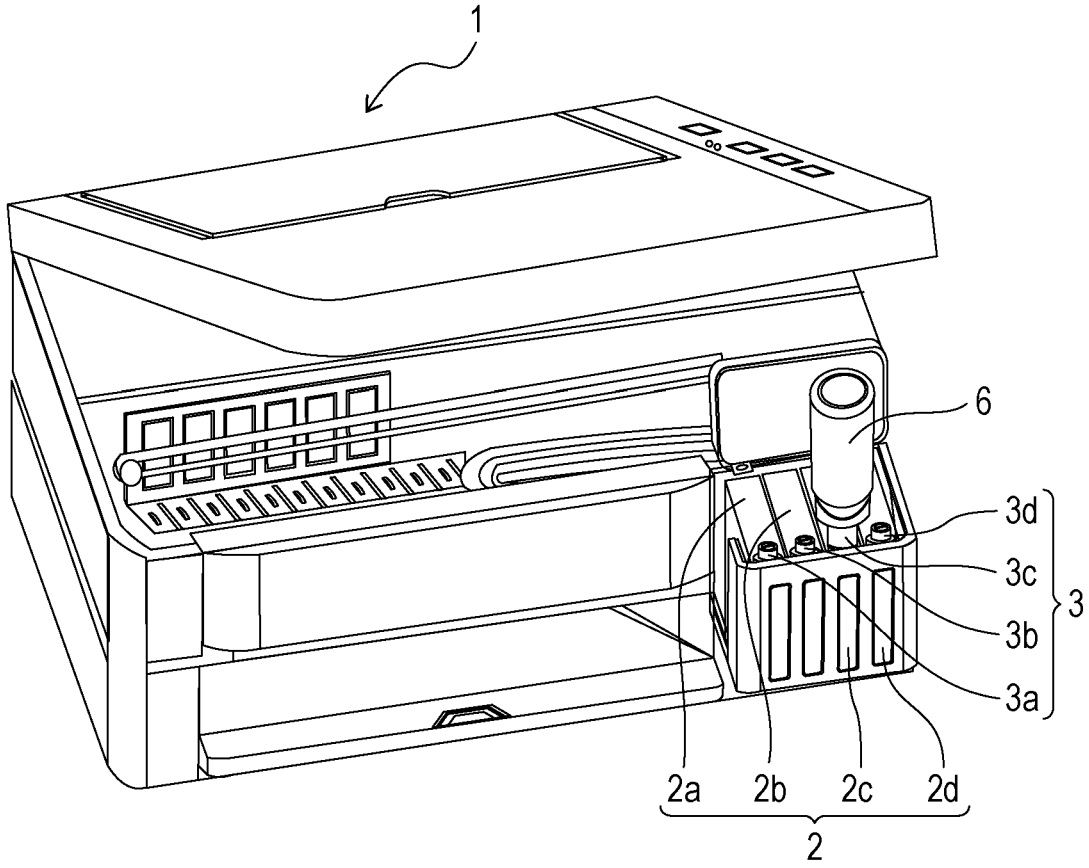
FIG. 1 is schematic illustration of an inkjet recording apparatus.

DESCRIPTION OF THE EMBODIMENTS while the present disclosure is described below with reference to exemplary embodiments, the present disclosure is not limited to the embodiments. In addition, all of the features and the combinations thereof described in the embodiments are not necessarily essential to the disclosure. Note that in the following description, the same reference numerals are used throughout to designate the same configurations. Furthermore, the relative positions and the shapes of constituent elements described in the embodiments are only illustrative. Therefore, the scope of the disclosure should not be construed as being limited by the relative positions and the shapes.

In Japanese Patent Laid-Open No. 2019-25862, since the protrusion is removably provided on the liquid refill container, the wrong protrusion may be unintentionally removed and, thus, the liquid storage container may still be refilled with a wrong color or type of liquid.

The present embodiment provides a liquid ejection apparatus and a liquid refill container capable of further reducing the risk of refilling the liquid storage container with liquid of a wrong color or type. According to the present embodiment, the risk of refilling the liquid storage container with liquid of a wrong color or type can be further reduced.

First Embodiment

An inkjet recording apparatus (hereinafter also referred to as a "recording apparatus") serving as a liquid ejection apparatus according to the first embodiment of the present disclosure is described below with reference to the accompanying drawings. FIG. 1 is a schematic illustration of an inkjet recording apparatus 1 according to the present embodiment. Note that an ink filling port cover 4 (described below) is not illustrated in FIG. 1.

The recording apparatus 1 includes ink tanks 2 (2*a* to 2*d*), each serving as an independent liquid storage container for one of the ink colors, and a recording head that ejects ink as a liquid ejection head. The recording apparatus 1 records an image on a recording medium by ejecting, from the recording head, ink supplied from the ink tanks 2. Note that when referring to the ink tanks each corresponding to one of the ink colors, description is provided using "ink tanks 2*a* to 2*d*". In contrast, when generally referring to ink tanks, regardless of ink color, description is provided using "ink tanks 2". Similarly, for a member other than the ink tank described below, the reference numeral is distinguished between a member described corresponding to one of the ink colors and the member generally described regardless of the ink color.

Figure 2:
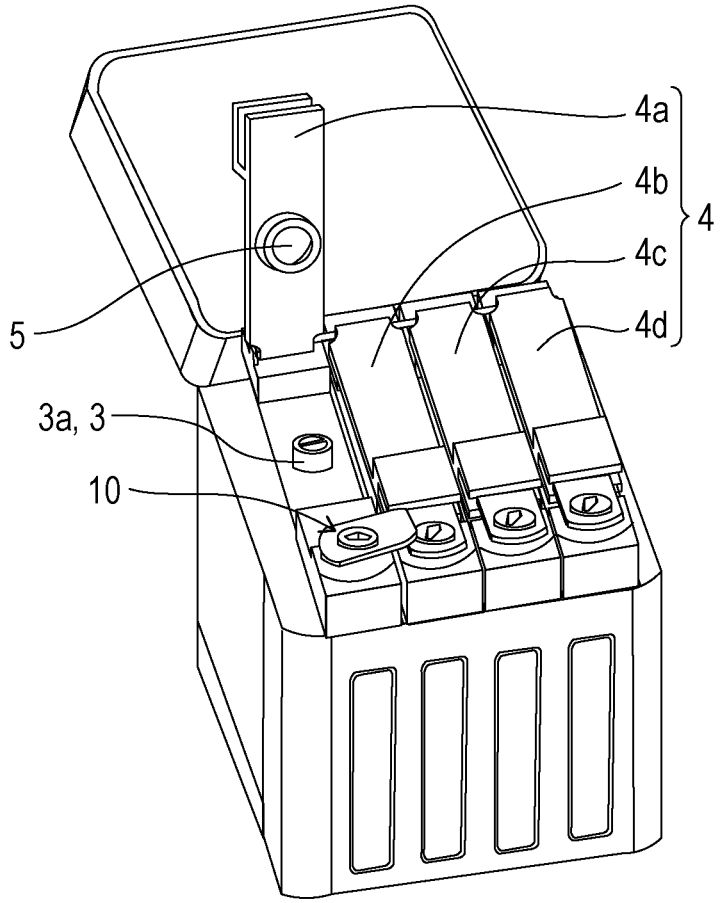
FIG. 2 is a schematic illustration of an ink tank according to a first embodiment.

FIG. 2 is a schematic illustration of the ink tanks 2 according to the present embodiment. The ink tanks 2 include an ink tank 2*a* for black ink, an ink tank 2*b* for cyan ink, an ink tank 2*c* for magenta ink, and an ink tank 2*d* for yellow ink. Each of the ink tanks 2*a* to 2*d* only need to be capable of storing ink of one of the colors, and the ink tanks 2*a* to 2*d* may be formed separately or may be integrated into a single unit.

The ink tanks 2*a* to 2*d* have storage portions that store ink inside and ink filling ports 3 (3*a* to 3*d*) serving as openings used to supply ink from external ink bottles 6 to the storage portions, respectively. In terms of the ink filling ports 3, the ink filling ports 3*a* to 3*d* are covered by ink filling port covers 4*a* to 4*d* which are cover members, respectively. Each of the ink filling port covers 4 is pivotally supported by a main body of the recording apparatus 1 and can be moved between a closed state for covering the ink filling port 3 of the ink tank 2 and an open state for exposing the ink filling port 3. FIG. 2 illustrates the ink filling port cover 4*a* that is open and, thus, the ink filling port 3*a* that is exposed. The ink filling port cover 4 is integrally provided with a cap mechanism 5 to close and seal the ink filling port 3.

Figure 3A:
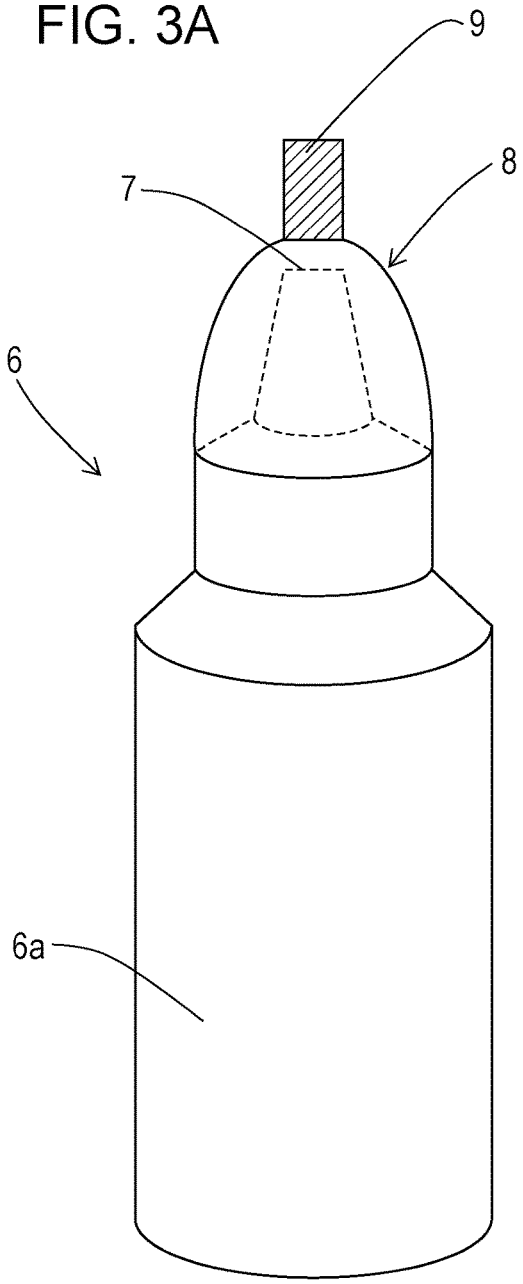
FIGS. 3A to 3E are schematic illustrations of an ink bottle according to the first embodiment.
Figure 3B:
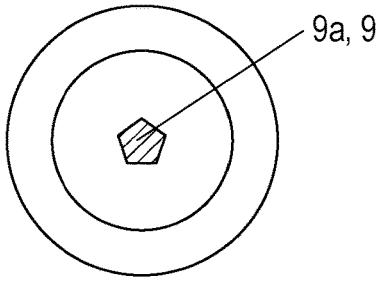
Figure 3C:
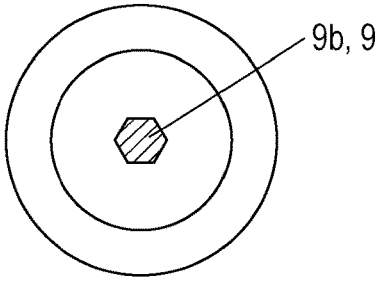
Figure 3D:
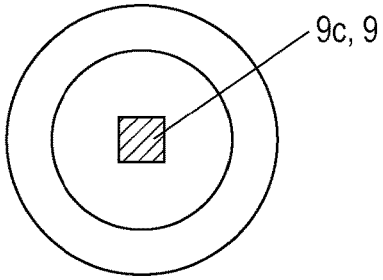
Figure 3E:
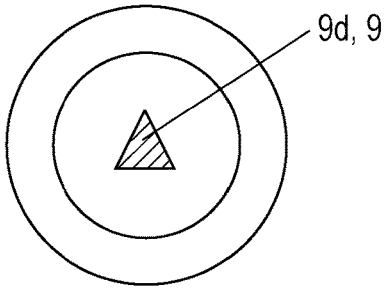

FIG. 3A is a schematic illustration of the ink bottle 6 (a refill container) storing ink that is used to refill the ink tank 2. The ink bottle 6 stores the refill ink inside a main body 6*a* thereof (a refill container body). For example, if the amount of ink in the ink tank 2 becomes small, a user injects ink from the ink bottle 6 into the ink filling port 3 and fills the ink tank 2 with the ink.

According to the present embodiment, an injection port 7 (an outlet port) for enabling the ink stored in the main body 6*a* of the ink bottle 6 to flow to the outside is covered by a screw cap 8 (a lid member) that can be opened and closed by a user. The user can repeatedly open and close the cap 8 as necessary to refill an ink tank with ink until the ink in the ink bottle 6 is completely consumed.

In addition, according to the present embodiment, a locking mechanism 10 (FIG. 2, FIGS. 4A to 4C) serving as a regulation unit is provided. The regulation unit regulates the transition from a closed state (a first state) in which the ink filling port cover 4 covers the ink filling port 3 to an open state (a second state) in which the ink filling port 3 is exposed. This restricts the user from unnecessarily opening the ink filling port cover 4. The locking mechanism 10 can be switched from a locked mode in which transition of the ink filling port cover 4 from the closed state to the open state is restricted to a mode in which transition from the closed state to open state is enabled if the lock mode is released by an unlocking mechanism.

Figure 4A:
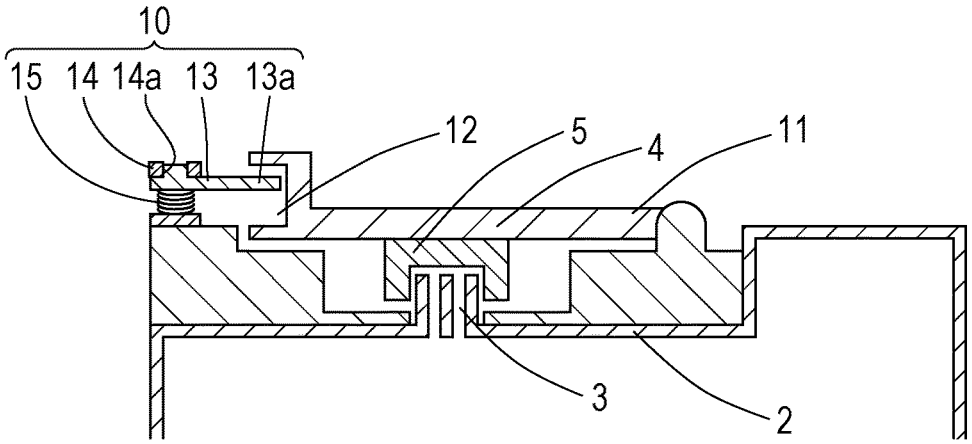
FIGS. 4A to 4C are schematic illustrations of a locking mechanism according to the first embodiment.
Figure 4B:
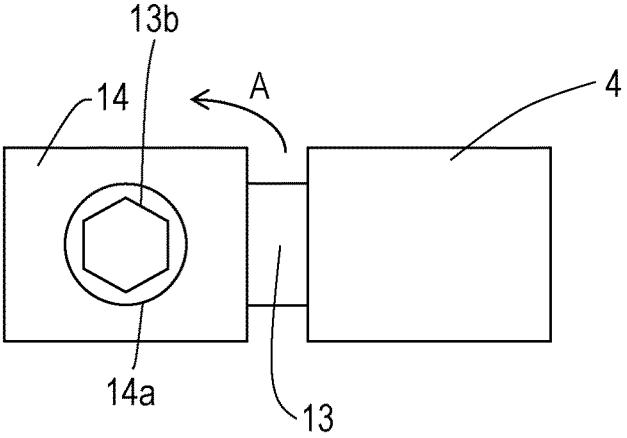
Figure 4C:
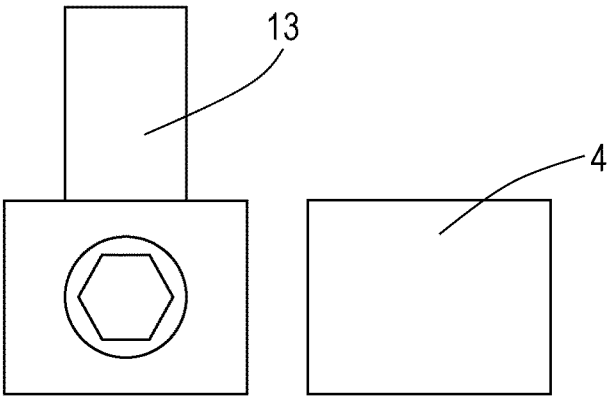

FIGS. 4A to 4C are diagrams for illustrating the locking mechanism 10. More specifically, FIG. 4A is a cross-sectional view of the ink tank 2 and its vicinity including the locking mechanism 10, and FIGS. 4B and 4C are top views of the locking mechanism 10 and part of the ink filling port cover 4.

A concave portion 12 (a third portion) is provided at an end opposite to an end 11 of the ink filling port cover 4 at which the ink filling port cover 4 is pivotally supported. The concave portion 12 is U-shaped in cross section, as illustrated in FIG. 4A. The locking mechanism 10 has a locking portion 13 with a convex portion 13*a* (a fourth portion) that can be fitted into the concave portion 12 of the ink filling port cover 4. Except during ink refilling, the concave portion 12 and the convex portion 13*a* of the locking portion 13 are fitted together, thus restricting transition of the ink filling port cover 4 to the open state and maintaining the ink filling port cover 4 in the closed state (FIG. 4A, FIG. 4B).

Furthermore, the locking portion 13 of the locking mechanism 10 is covered by a locking portion cover 14, which has a protrusion insertion opening 14*a* into which a protrusion 9 provided on the tip of the cap 8 of the ink bottle 6 is to be inserted. The locking portion 13 has an opening 13*b* exposed through the protrusion insertion opening 14*a*. The opening 13*b* of the locking portion 13 has the same shape and dimensions as the contour of the protrusion 9 of the cap 8 of the ink bottle 6. The protrusion 9 of the ink bottle 6 is inserted into the opening 13*b* through the protrusion insertion opening 14*a* with the protrusion 9 of the ink bottle 6 facing downward. At this time, by rotating the locking portion 13 in the direction of arrow A while pushing the locking portion 13 downward by using the protrusion 9 of the ink bottle 6, the lock mode is released (FIG. 4C), and the ink filling port cover 4 can be opened. Note that the locking portion 13 is attached to the main body of the recording apparatus 1 via a biasing member 15 (that is a spring in the present embodiment) that can push the locking portion 13.

Figure 5A:
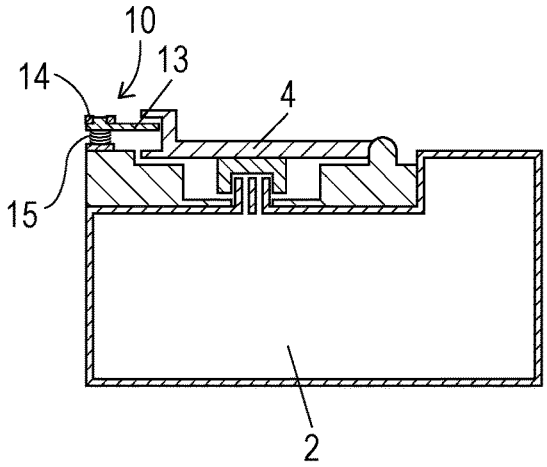
FIGS. 5A to 5D are schematic illustrations of an ink refilling procedure according to the first embodiment.
Figure 5C:
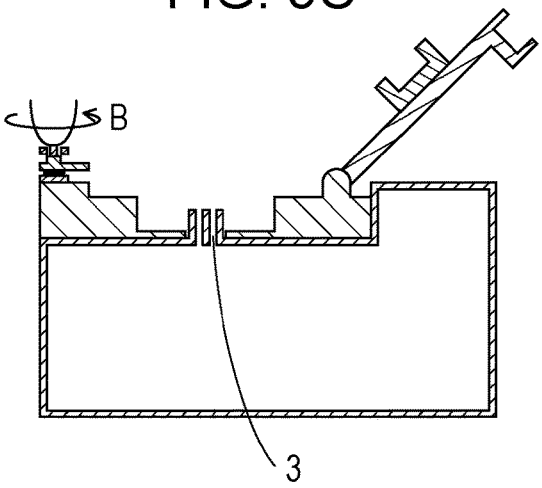
Figure 5B:
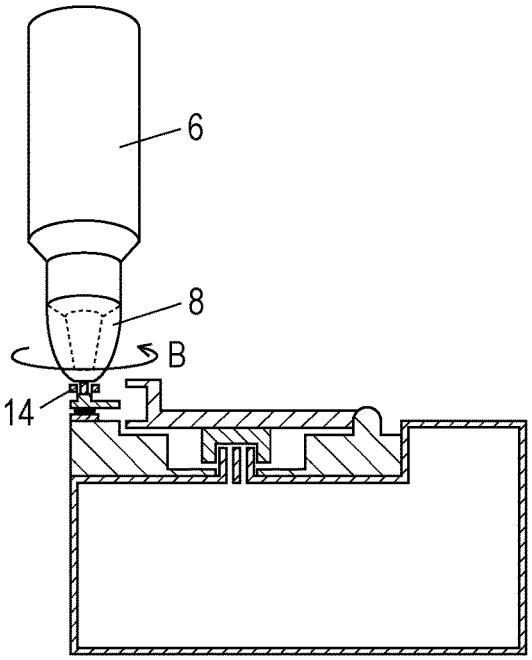
Figure 5D:
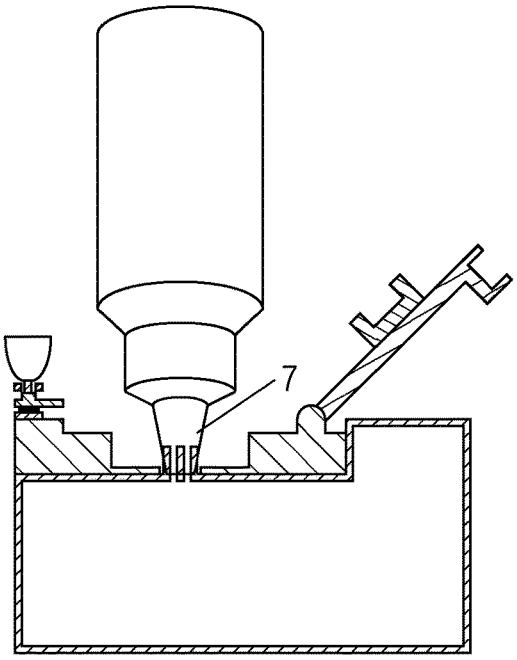

FIGS. 5A to 5D are schematic cross-sectional views illustrating the procedure for refilling the ink tank 2 with ink. FIG. 5A illustrates the ink filling port cover 4 locked into a closed state by the locking mechanism 10. To refill the ink tank 2, the protrusion 9 of the cap 8 of the ink bottle 6 that stores ink of the same color as in the ink tank 2 to be refilled is inserted into the opening 13*b* through the protrusion insertion opening 14*a*. Thereafter, the locking portion 13 is pushed downward by using the ink bottle 6 to separate the locking portion 13 from the locking portion cover 14 in a downward direction, so that the biasing member 15 enters a mode in which the biasing member 15 is pressed. After the biasing member 15 enters this mode, the ink bottle 6 is rotated in the direction of arrow B to release the fitting of the concave portion 12 and the locking portion 13 so as to release the locked mode (FIG. 5B). Subsequently, the unlocked ink filling port cover 4 is opened so that the ink filling port 3 is exposed (FIG. 5C). Thereafter, the cap 8 of the ink bottle 6 is removed to expose the injection port 7 of the ink bottle 6, and the ink is fed through the ink filling port 3 (FIG. 5D).

Note that as illustrated in FIGS. 5C and 5D, a configuration may be employed in which even after the lock mode of the ink filling port cover 4 is released, the rotation operation of the ink bottle 6 is continued so that the cap 8 can be removed from the main body 6*a* of the ink bottle 6 while the cap 8 is held by the locking portion 13. For example, a stopper is provided to limit the rotation of the locking portion 13 after the locked ink filling port cover 4 is released. In this manner, if rotation of the main body 6*a* of the ink bottle 6 in the direction of arrow B is continued even after the ink filling port cover 4 is unlocked, the rotation of the cap 8 is limited by the stopper. Thus, the main body 6*a* is rotated relative to the cap 8, and the cap 8 can be removed. This configuration is desirable because the convenience of the user increases.

Note that the ink tanks 2*a* to 2*d* have different shapes of the openings 13*b*, and the shapes of the protrusions 9 of the caps 8 of the ink bottles 6 inserted into the respective openings 13*b* are also different from one other. That is, only the ink bottle 6 corresponding to the ink in one of the ink tanks 2*a* to 2*d* can unlock the locking mechanism 10 of the ink tank. For example, the ink bottles 6 have protrusions 9 (9*a* to 9*d*) formed thereon, and the protrusions 9 have different external shapes each corresponding to one of the ink colors, as illustrated in FIGS. 3B to 3E, so that the external shapes are the same as the shapes of the openings 13*b* of the ink tanks 2*a* to 2*d*, respectively. In this way, only the protrusion 9 provided on the cap 8 of the ink bottle 6 of a color corresponding to the ink tank 2 can be inserted into the opening 13*b* and can operate the locking portion 13, while the protrusion 9 of the ink bottle 6 of any one of the other colors cannot operate the locking portion 13. This prevents the ink tank 2 from being refilled with ink of a wrong color.

Note that the configuration described in Japanese Patent Laid-Open No. 2019-25862, that is, the configuration in which ink misfilling is prevented by changing the shape of the ink supply port 3 and the vicinity of the injection port 7 of the ink bottle 6 in accordance with the corresponding color has the following problem. That is, the injection port 7 of the ink bottle 6 of a wrong color may be brought into contact with the ink filling port 3. For this reason, ink that has adhered to the vicinity of the ink filling port 3 may adhere to the vicinity of the injection port 7 of the ink bottle 6, or ink that has adhered to the vicinity of the injection port 7 of the ink bottle 6 may adhere to the vicinity of the ink filling port 3. As a result, ink of a different color may be mixed with the ink in the ink tank 2 or the ink bottle 6. In contrast, the present embodiment provides the configuration in which the ink filling port cover 4 is locked by a locking mechanism 10, which can be released only by the corresponding ink bottle 6. This configuration can prevent the above-described mixing of ink.

As described above, the present embodiment provides the configuration in which to prevent refilling of ink of a wrong color (ink misfilling), the locking mechanism 10 is released only when the protrusion 9 of the cap 8 of the ink bottle 6 of the corresponding color (type) is fitted into the opening 13*b* of the locking portion 13 of the ink tank 2. However, the present disclosure is not limited to the configuration described above, and the configuration may be such that the lock mode of the ink filling port cover 4 is released when the first portion of the ink bottle for preventing ink misfilling is fitted into the second portion of the recording apparatus 1. For example, a mechanism for preventing ink misfilling may be provided in a portion of the ink bottle 6 other than the cap 8.

It is desirable that the protrusion 9 of the cap 8 of the ink bottle 6 is colored in the same color as the color of a corresponding ink, because the visibility is improved, which increases the effect of preventing misfilling of ink.

Second Embodiment

A second embodiment of the present disclosure is described below. The configuration of a recording apparatus 1 is the same as that of the recording apparatus 1 according to the above-described embodiment. In addition, the second embodiment has a configuration that is the same as in the above-described embodiment in that the lock mode of the ink filling port cover 4 is released by using the protrusion 9 of the cap 8 of the ink bottle 6 storing the ink corresponding to the ink tank 2. According to the present embodiment, the configuration of the locking mechanism 10 for controlling the opening and closing of the ink filling port cover 4 and the method for releasing the lock mode differ from those of the above-described embodiment.

Figure 6A:
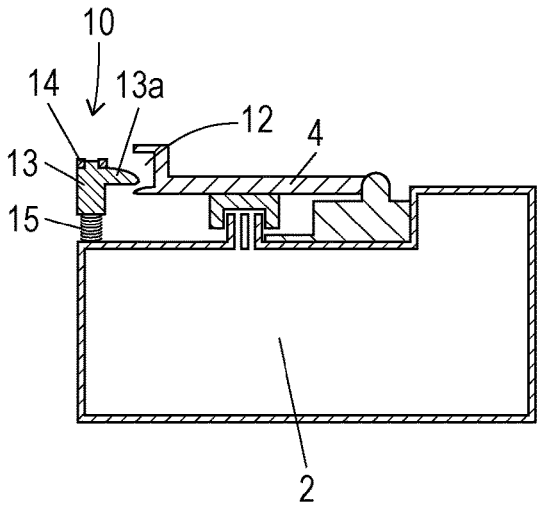
FIGS. 6A to 6D are schematic illustrations of an ink refilling procedure according to a second embodiment.
Figure 6C:
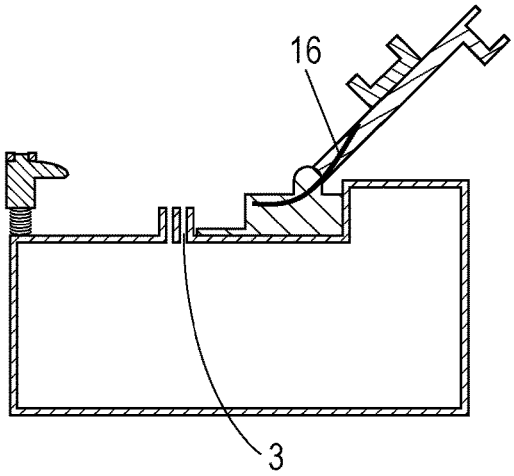
Figure 6B:
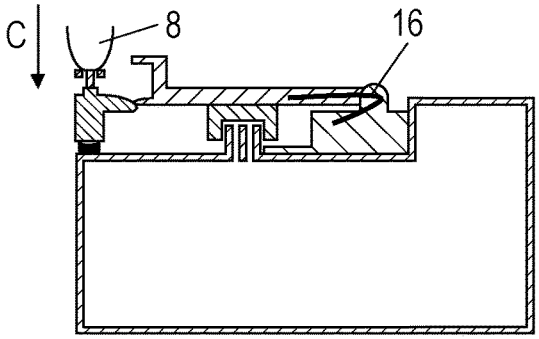
Figure 6D:
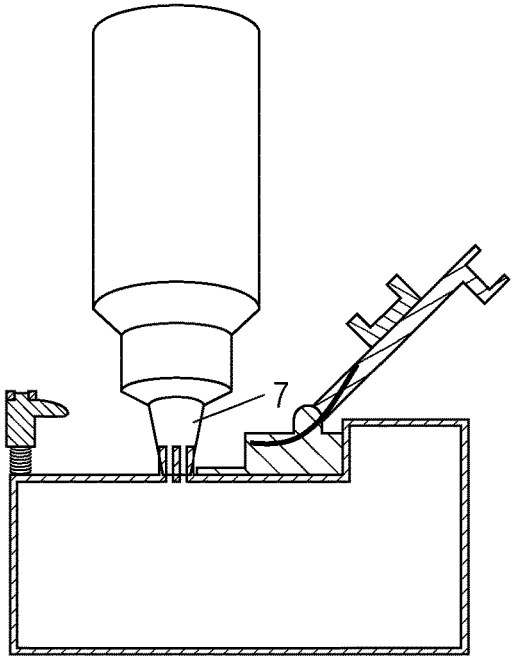

FIGS. 6A to 6D are schematic cross-sectional views illustrating the procedure for refilling the ink tank 2. FIG. 6A illustrates the ink filling port cover 4 that is in a closed state and is locked by the locking mechanism 10. At this time, the convex portion 13*a* of the locking portion 13 that constitutes the locking mechanism 10 is fitted to the concave portion 12 of the ink filling port cover 4. To refill the ink tank 2 with ink, the protrusion 9 of the cap 8 of the ink bottle 6 for the same color as the ink in the ink tank 2 to be refilled is inserted into the opening 13*b* through the protrusion insertion opening 14*a*. Subsequently, the locking portion 13 is pushed downward (in the direction of arrow C) with the ink bottle 6 so that the locking portion 13 separates from the locking portion cover 14 downward and the biasing member 15 is pressed. By pushing the locking portion 13 of the ink tank 2 downward in this manner, fitting between the concave portion 12 of the ink filling port cover 4 and the convex portion 13*a* of the locking portion 13 is released, and the locking portion 13 moves downward, deactivating the lock mode (FIG. 6B). Note that a spring 16 (an elastic body) that connects the main body of the recording apparatus 1 (or the ink tank 2) to the ink filling port cover 4 may be provided, and the spring 16 may be used to hold the ink filling port cover 4 in the open state when the convex portion 13*a* and the concave portion 12 are not fitted to each other. This configuration allows the ink filling port cover 4 to automatically open when the lock mode is released and, thus, the ink filling port 3 is exposed (FIG. 6C). This configuration can increase the convenience of the user. Subsequently, the cap 8 of the ink bottle 6 is removed to expose the injection port 7 of the ink bottle 6, and the ink bottle 6 is refilled with ink through the ink filling port 3 (FIG. 6D).

Unlike the above-described embodiment, the present embodiment does not require rotation of the ink bottle 6, and the lock can be unlocked by only a pushing operation. Therefore, in addition to the shape and dimensions of the opening 13*b*, the shape and dimensions of the protrusion insertion opening 14*a* are made in the same as those of the protrusion 9 of the cap 8 of the corresponding ink bottle 6. This prevents the ink filling port cover 4 from being opened by the protrusion 9 of the cap 8 of the ink bottle 6 that stores ink of a color different from the color of ink stored in the ink tank 2. In this manner, misfilling of the ink tank 2 from the ink bottle 6 storing ink of a wrong color can be prevented.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-033878, filed Feb. 28, 2020, which is hereby incorporated by reference herein in its entirety.

What is claimed is:

1. A liquid ejection apparatus comprising:

a liquid ejection head configured to eject liquid;

a liquid storage container including a storage portion configured to store liquid to be supplied to the liquid ejection head, an opening configured to supply liquid from a liquid refill container to the storage portion, and a cover member configured to be in a first state to cover the opening and a second state to expose the opening; and a regulation unit configured to regulate transition from the first state to the second state of the cover member, wherein regulating by the regulation unit is released when a first portion, of the liquid refill container, configured to prevent misfilling the storage portion with liquid is fitted into a second portion of the liquid ejection apparatus.

2. The liquid ejection apparatus according to claim 1, wherein the regulation unit is configured to regulate the transition of the cover member when a third portion of the cover member is fitted into a fourth portion of the regulation unit.

3. The liquid ejection apparatus according to claim 1, wherein the second portion of the liquid ejection apparatus is provided in the regulation unit.

4. The liquid ejection apparatus according to claim 1, wherein the liquid refill container includes a refill container body configured to store liquid, an outlet port configured to enable liquid in the refill container body to flow to an outside, and a lid member configured to cover the outlet port, wherein the first portion of the liquid refill container is provided in the lid member.

5. The liquid ejection apparatus according to claim 4, wherein the first portion of the liquid refill container is a protrusion formed on the lid member, and the second portion of the liquid ejection apparatus is an opening that fits the protrusion.

6. The liquid ejection apparatus according to claim 4, wherein regulating by the regulation unit is released when the liquid refill container is rotated with the first portion of the liquid refill container being fitted to the second portion of the liquid ejection apparatus so as to rotate the regulation unit.

7. The liquid ejection apparatus according to claim 6, wherein a rotation of the regulation unit is regulated in a state in which regulating by the regulating unit is released, and wherein the lid member can be removed from the refill container body by rotating the refill container body relative to the lid member with the first portion of the liquid refill container being fitted to the second portion of the liquid ejection apparatus.

8. The liquid ejection apparatus according to claim 4, wherein regulating by the regulation unit is released by pressing the regulation unit by using the liquid refill container with the first portion of the liquid refill container being fitted to the second portion of the liquid ejection apparatus.

9. The liquid ejection apparatus according to claim 8, further comprising an elastic member connected to the cover member such that the cover member is maintained in the second state in a state in which regulating by the regulating unit is released.

10. The liquid ejection apparatus according to claim 1, wherein the storage portion includes a first storage portion and a second storage portion that store different types of liquid, wherein the cover member includes a first cover member that covers the opening corresponding to the first storage portion and a second cover member that covers the opening corresponding to the second storage portion, wherein the regulation unit includes a first regulation unit that regulates the transition of the first cover member and a second regulation unit that regulates the transition of the second cover member, and wherein the second portion of the liquid ejection apparatus corresponding to the first storage portion differs from the second portion of the liquid ejection apparatus corresponding to the second storage portion in shape so that: regulating by the first regulation unit is capable of being released by only the first portion of a first liquid refill container storing liquid to be supplied to the first storage portion; and regulating by the second regulation unit is capable of being released by only the first portion of a second liquid refill container storing liquid to be supplied to the second storage portion.

11. A liquid refill container for supplying liquid to a storage portion of a liquid ejection apparatus, the liquid ejection apparatus including a liquid ejection head configured to eject liquid, a liquid storage container including the storage portion configured to store liquid to be supplied to the liquid ejection head, an opening configured to supply liquid from the liquid refill container to the storage portion, and a cover member configured to be on a first state to cover the opening and a second state to expose the opening, and a regulation unit configured to regulate transition from the first state to the second state of the cover member, the liquid refill container comprising a first portion configured to prevent misfilling the storage portion with liquid, wherein regulating by the regulation unit is released when the first portion is fitted into a second portion of the liquid ejection apparatus.

12. The liquid refill container according to claim 11, further comprising:

a refill container body configured to store liquid;

an outlet port that enables the liquid in the refill container body to flow to an outside; and a lid member configured to cover the outlet port, wherein the first portion of the liquid refill container is provided in the lid member.

13. The liquid refill container according to claim 11, wherein the first portion of the liquid refill container has a color which is the same as a color of liquid stored in the liquid refill container.

* * * * *